US010422168B2

(12) United States Patent
Chang

(10) Patent No.: US 10,422,168 B2
(45) Date of Patent: Sep. 24, 2019

(54) ENERGY-SAVING MAGNETIC LOCK

(71) Applicant: Shaghai One Top Corporation, Shanghai (CN)

(72) Inventor: Tsung-Chih Chang, Shanghai (CN)

(73) Assignee: SHANGHAI ONE TOP CORPORATION, Shanghai (CN)

( * ) Notice: Subject to any disclaimer, the term of this patent is extended or adjusted under 35 U.S.C. 154(b) by 1156 days.

(21) Appl. No.: 14/646,890

(22) PCT Filed: May 21, 2013

(86) PCT No.: PCT/CN2013/075985
§ 371 (c)(1),
(2) Date: May 22, 2015

(87) PCT Pub. No.: WO2014/079207
PCT Pub. Date: May 30, 2014

(65) Prior Publication Data

US 2015/0308170 A1 Oct. 29, 2015

(30) Foreign Application Priority Data

Nov. 23, 2012 (CN) ..... 2012 1 0484168

(51) Int. Cl.
*E05B 47/00* (2006.01)
*E05C 17/56* (2006.01)
(Continued)

(52) U.S. Cl.
CPC ..... *E05C 17/56* (2013.01); *E05B 47/00* (2013.01); *E05C 19/166* (2013.01); *E05B 45/06* (2013.01); *E05B 2047/0065* (2013.01)

(58) Field of Classification Search
CPC ..... E05C 17/56; E05C 19/166; E05B 47/00; E05B 2047/0065; E05B 45/06
See application file for complete search history.

(56) References Cited

U.S. PATENT DOCUMENTS 6,053,546 A * 4/2000 Frolov ..... E05C 19/166 292/144
6,609,738 B1 8/2003 Roth
(Continued)

FOREIGN PATENT DOCUMENTS

CN 2358164 Y 1/2000
CN 2623809 Y 7/2004
(Continued)

OTHER PUBLICATIONS

International Search Report and Written Opinion dated Aug. 29, 2013 from PCT App. No. PCT/CN2013/075985.
(Continued)

*Primary Examiner* — Kristina R Fulton
*Assistant Examiner* — Thomas L Neubauer
(74) *Attorney, Agent, or Firm* — James E. Walton

(57) ABSTRACT

An energy-saving magnetic lock comprising: a first lock module (I) mounted to a part of a door such as a doorframe; and a second lock module (II), mounted to the other part of the door such as a door panel which can pivot about the doorframe, for interacting with the first lock module (I), wherein the first lock module (I) comprises: an electromagnet (1); a slot (12); a trip rod (11) inserted inside the slot; a sensor (13) equipped at the slot end; a member, which is arranged between the trip rod (11) and the slot (12), allowing the trip rod to move toward the slot opening axially a predetermined distance when the pressing force on the head of the trip rod (11) is less than the predetermined value; a circuit control board (15), wherein the trip rod (11) has a length equal to the distance between the slot opening and a surface of the sensor (13) facing the slot opening, the second
(Continued)

lock module (II) comprises: an iron plate (2) installed on or in the part of the door panel by a main screw (21), wherein the main screw (21) comprises: a rod whose end passes through a counterbore (22) of the iron plate (2) and being secured to the part of the door; and a cap (211) abutting against the head of the trip rod (11) when the electromagnet (1) and the iron plate (2) are sucked together and wherein a first elastic member (23) is arranged between the iron plate (2) and the cap (211) of the main screw (21), and a second elastic member (24) is arranged between the iron plate and the part of the door. The lock can save energy and have added alarm function thereby security is strengthened.

13 Claims, 3 Drawing Sheets

(51) Int. Cl.
*E05C 19/16* (2006.01)
*E05B 45/06* (2006.01)

(56) References Cited

U.S. PATENT DOCUMENTS

| | | | | |
|---|---|---|---|---|
| 8,757,685 | B2 * | 6/2014 | Chang | E05C 17/56 292/251.5 |
| 8,919,159 | B2 * | 12/2014 | Witte | E05B 17/0004 70/257 |
| 2010/0218569 | A1 | 9/2010 | Hunt | |
| 2013/0300136 | A1 * | 11/2013 | Suresha | E05B 3/003 292/336.3 |

FOREIGN PATENT DOCUMENTS

| | | | |
|---|---|---|---|
| CN | 2893082 | Y | 4/2007 |
| CN | 102677979 | Y | 9/2012 |
| CN | 102943592 | A | 2/2013 |

OTHER PUBLICATIONS

International Report on Patentability dated May 26, 2015 from PCT App. No. PCT/CN2013/075985.

* cited by examiner

ENERGY-SAVING MAGNETIC LOCK

FIELD OF THE INVENTION

The invention relates to an electrically controlled lock, especially to an energy-saving magnetic lock.

BACKGROUND OF THE INVENTION

Electronically controlled magnetic locks are used in the escape doors, for the purpose of anti-theft and escape, in the field of entrance guard more than 30 years. Such locks play an indelible role in the security aspect. Existing electronically controlled magnetic locks normally are in a locked mode as they are powered on, and are in an unlocked mode as they are powered off in the case of fire, emergency or access control. Magnetic lock tension F=K*AT, where A is the current, T is the number of turns. In accordance to the equation, the only way to increase the tension is to increase the current, however, the greater the current is and the longer the current power-on time is, power consumption is greater. The current power-on time is very long because the electronically controlled magnetic lock normally is in a power-on state. The current consumption will be high if current is great. This does not meet energy saving and emissions reduction requirements which countries around the world strongly advocated in recent years.

OBJECT OF THE INVENTION

The object of the present invention is to provide an energy saving magnetic lock, which is in a normal low current state, is instantly converted to a high current state when a sensor senses artificial external force is equal to or greater than the predetermined value to overcome the above disadvantages of the existing magnetic locks often at a high current.

SUMMARY OF THE INVENTION

The invention provides an energy-saving magnetic lock, the energy-saving magnetic lock comprising:

a first lock module (I) mounted to a part of a door such as a doorframe; and a second lock module (II), mounted to the other part of the door such as a door panel which can pivot about the doorframe, for interacting with the first lock module (I), wherein the first lock module (I) comprises:

an electromagnet;

a slot with an opening in a suction surface of the electromagnet extending to the bottom of the electromagnet;

a trip rod inserted inside the slot;

a sensor equipped at the slot end;

a member, which is arranged between the trip rod and the slot, allowing the trip rod to move toward the slot opening axially a predetermined distance when the pressing force on the head of the trip rod is less than the predetermined value;

a circuit control board to which the electromagnet and the sensor are electrically coupled respectively, wherein the trip rod has a length equal to the distance between the slot opening and a surface of the sensor facing the slot opening, the second lock module (II) comprises:

an iron plate installed on or in the part of the door panel by a main screw, wherein the main screw comprises: a rod whose end passes through a counterbore of the iron plate and being secured to the part of the door; and a cap abutting against the head of the trip rod when the electromagnet and the iron plate are sucked together and wherein a first elastic member is arranged between the iron plate and the cap of the main screw, and a second elastic member is arranged between the iron plate and the part of the door.

In a preferred embodiment, the member, which is arranged between the trip rod and the slot, allowing the trip rod to move toward the slot opening axially a predetermined distance when the pressing force on the head of the trip rod is less than the predetermined value comprises: a flange projecting radially outwardly from a side wall of the trip rod; at least two adjacent channels of different diameter constituting the slot; and a spring arranged around the outer periphery of the trip rod between the flange of the trip rod and the slot.

In a preferred embodiment, the slot comprises three adjacent sections, which comprise a first channel, a second channel and a third channel, each is a concentric cylindrical channel with an incremental diameter from the suction face of the electromagnet.

In a preferred embodiment, the first channel has a diameter which is greater than the rod diameter of the trip rod but smaller than the flange diameter of the trip rod. The second channel has a diameter which is greater than the flange diameter of the trip rod. The third channel has a headless screw secured therein. The headless screw is opened a central bore through which the tail of the trip rod passes.

In a preferred embodiment, the spring is arranged between the flange of the trip rod and the headless screw secured inside the slot.

In a preferred embodiment, the sensor has a "U"-like shape and an inductive surface of the sensor faces the center of the headless screw.

In a preferred embodiment, the tail of the trip rod passes through the headless screw and arrives at the center of the sensor where the trip rod is axially movable.

In a preferred embodiment, the sensor can be a pressure sensor or an optocoupling sensor.

In a preferred embodiment, the open position of the counterbore in the suction surface of the iron plate corresponds to the open position of the slot in the suction surface of the electromagnet. The counterbore comprises three adjacent sections, which each is a concentric cylindrical channel with a progressive decreased diameter from the suction surface of the iron plate.

In a preferred embodiment, the counterbore comprises a first channel for receiving the cap of the main screw, a second channel for receiving the first elastic member, and a third channel for receiving a part of the rod of the main screw. During assembly of the second lock module (II), the tail of the main screw passes through a center hole of the first elastic member into the third channel, then passes through the third channel and a central hole of the second elastic member arranged between the iron plate and the part of the door, and finally the tail of the main screw is fixed to the part of the door.

In a preferred embodiment, the first elastic member can be a butterfly shrapnel or a spring.

In a preferred embodiment, the second elastic member can be a rubber ring.

In a preferred embodiment, the first lock module (I) further comprises a lock housing for supporting and packaging it. The lock housing is provided with a indicator which is electrically coupled to the circuit control board.

In comparison with the prior art, the solution of the present invention has the advantages as follows:

The magnetic lock of the present invention, often in energy-saving state with low current operation, is converted from the energy saving state to a high tensile state once an external invasion force occurs, also issues short-range and long-range alerts for warning the external invasion to end, saving energy and having added alarm function, strengthening security of the magnetic lock.

DETAILED DESCRIPTION OF THE PREFERRED EMBODIMENTS

Figure 1:
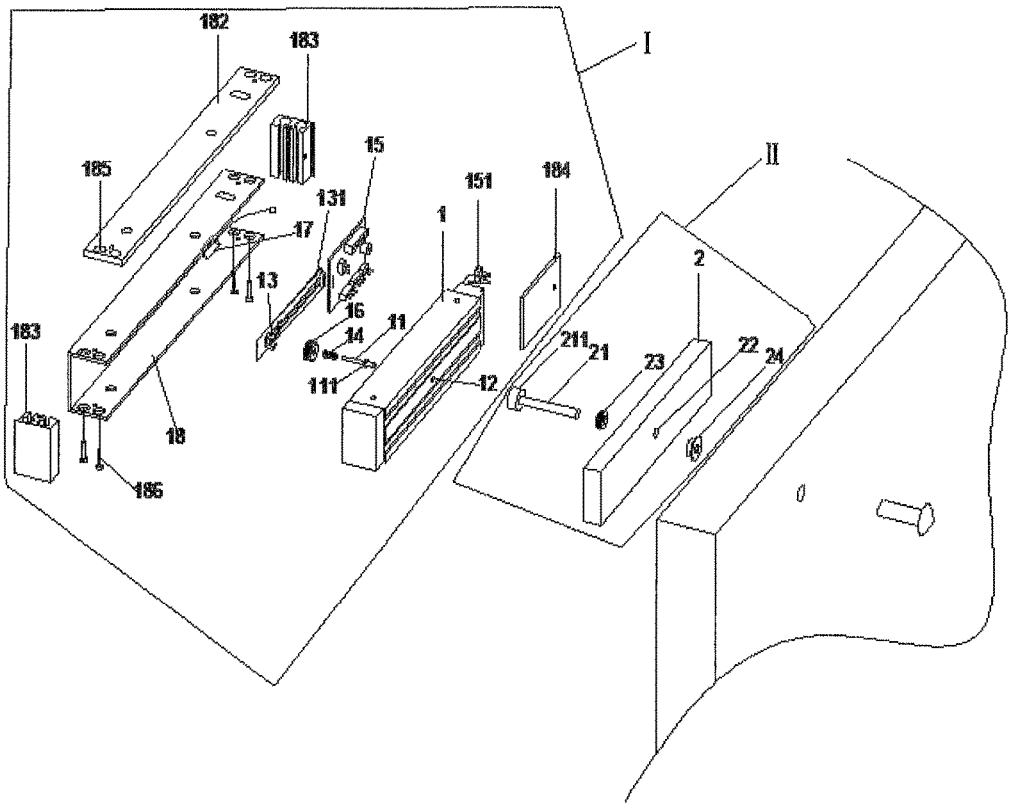
FIG. 1 is an exploded view of an energy saving magnetic lock according to an embodiment of the present invention.

The energy-saving magnetic lock according to an embodiment of the present invention is shown in FIG. 1. The energy-saving magnetic lock comprises a first lock module (I) mounted to a doorframe and a second lock module (II), mounted to a door panel which can pivot about the doorframe, for interacting with the first lock module (I). The first lock module (I) comprises an electromagnet 1 and a trip rod 11. A slot 12 with an opening in a suction face of the electromagnet 1 extends to the bottom of the electromagnet 1. The trip rod 11 is inserted inside the slot 12 and a sensor 13 is equipped at the slot end. The trip rod 11 has a length equal to the distance between the slot opening and a surface of the sensor 13 facing the slot opening. A member, which is disposed between the trip rod 11 and the slot 12, allows the trip rod to move toward the slot opening axially a predetermined distance when the pressing force on the head of the trip rod is less than the predetermined value. The electromagnet 1 and the sensor 13 are electrically coupled to a circuit control board 15 respectively. The second lock module (II) comprises an iron plate 2 installed on or in the door panel by a main screw 21. The main screw 21 comprises a rod whose end passes through a counterbore 22 of the iron plate 2 and is secured to the door panel, and a cap 211 of the main screw 21 abuts against the head of the trip rod 11 when the electromagnet 1 and the iron plate 2 are sucked together. A first elastic member 23 is disposed between the iron plate 2 and the cap 211 of the main screw 21, and a second elastic member 24 is disposed between the iron plate 2 and the door panel. The first and second elastic members 23 and 24 allow the main screw 21 to axially move with respect to the iron plate 2.

Figure 3:
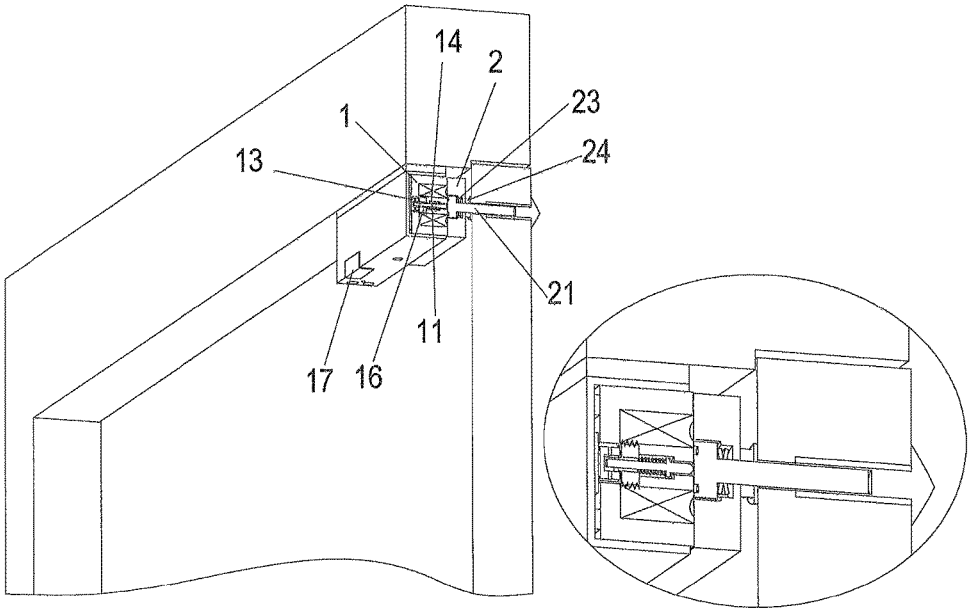
FIG. 3 is a cross section view of the energy saving magnetic lock shown in FIG. 1 in the normal locked condition when the door is closed.
Figure 4:
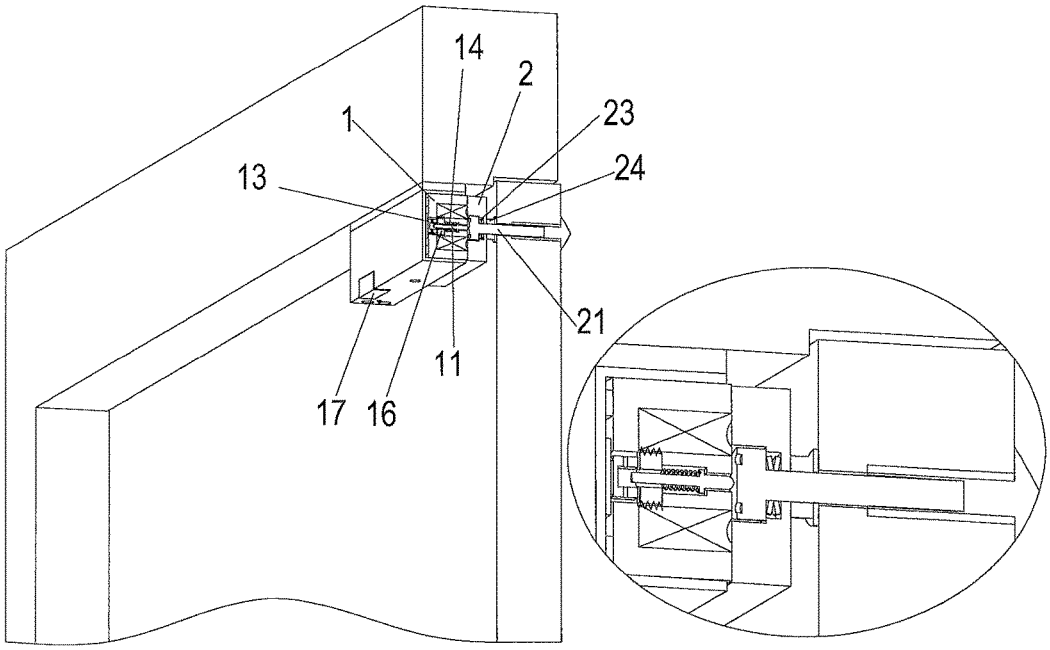
FIG. 4 is a cross section view of the energy saving magnetic lock shown in FIG. 1 under an external invasion force when the door is closed.
Figure 5:
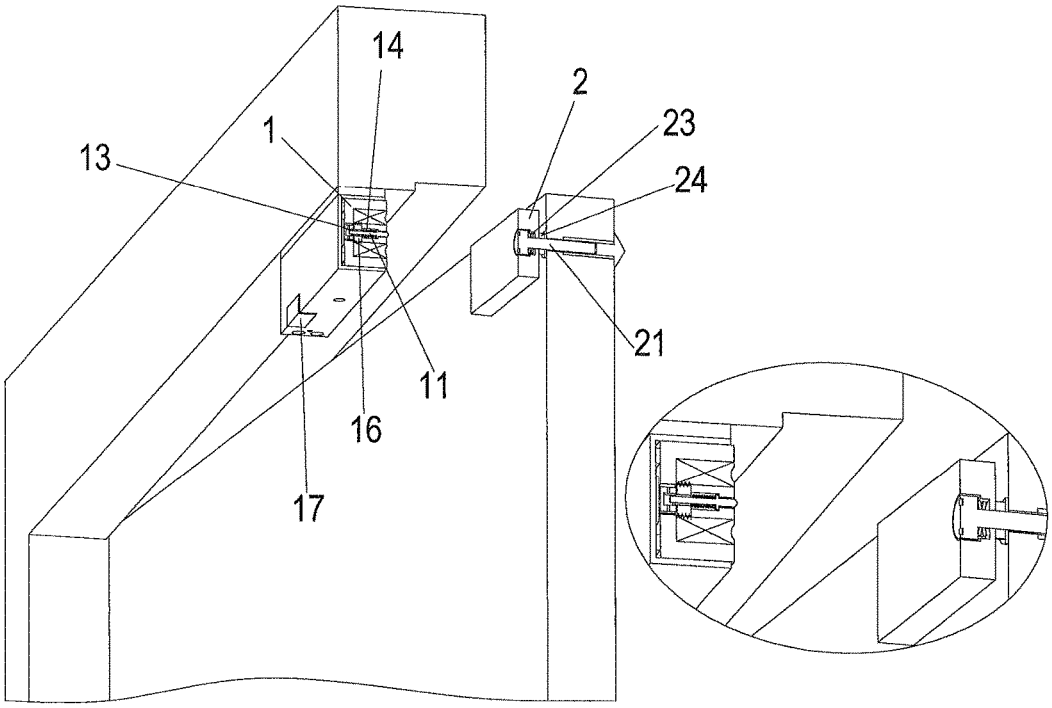
FIG. 5 is a cross section view of the energy saving magnetic lock shown in FIG. 1 in the unlocked condition when the door is open.

The member, which is disposed between the trip rod 11 and the slot 12, allowing the trip rod 11 to move toward the slot opening axially a predetermined distance when the pressing force on the head of the trip rod is less than the predetermined value comprises: a flange 111 projecting radially outwardly from a side wall of the trip rod, at least two adjacent channels of different diameter constituting the slot 12, and a spring 14 arranged around the outer periphery of the trip rod 11 between the flange 111 of the trip rod 11 and the slot 12. The purpose of the flange 111 is to limit movement distance of the trip rod 11 so as to avoid it out of the slot 12. The axis of the slot 12 is perpendicular to the suction surface of the electromagnet 1. As shown in FIGS. 3, 4 and 5, the slot 12 comprises three adjacent sections, which comprise a first channel, a second channel and a third channel, each is a concentric cylindrical channel with an incremental diameter from the suction surface of the electromagnet 1. The first channel has a diameter which is greater than the rod diameter of the trip rod 11 but smaller than the flange diameter of the trip rod 11. The second channel has a diameter which is greater than the flange diameter of the trip rod 11. The third channel has a headless screw 16 secured therein. The headless screw 16 is opened a central bore through which the tail of the trip rod 11 passes. The trip rod 11 engages with the headless screw 16. The spring 14 is arranged between the flange 111 of the trip rod 11 and the headless screw 16 secured inside the slot 12. The sensor 13 can be a pressure sensor or an optocoupling sensor. An inductive face of the sensor 13 faces the center of the headless screw. Preferably, the sensor 13 has a "U"-like shape. The tail of the trip rod 11 passes through the headless screw 16 and arrives at the center of the sensor 13 where the trip rod 11 is axially movable.

The circuit control board 15, to which the sensor 13 is electrically coupled, is provided with a DC input port, an automatic switching module of current level, a voltage output port, a warning signal trigger input port, and a warning signal trigger output port. The sensor 13 is electrically coupled to the warning signal trigger input in the circuit control board 15. A voltage input port of electromagnet 1 is coupled to the voltage output port in the circuit control board 15 via a terminal 151. A signal input port of an indicator 17 is coupled to the warning signal trigger output port in the circuit control board 15. The indicator 17 can play the role of visual alarm.

Figure 2:
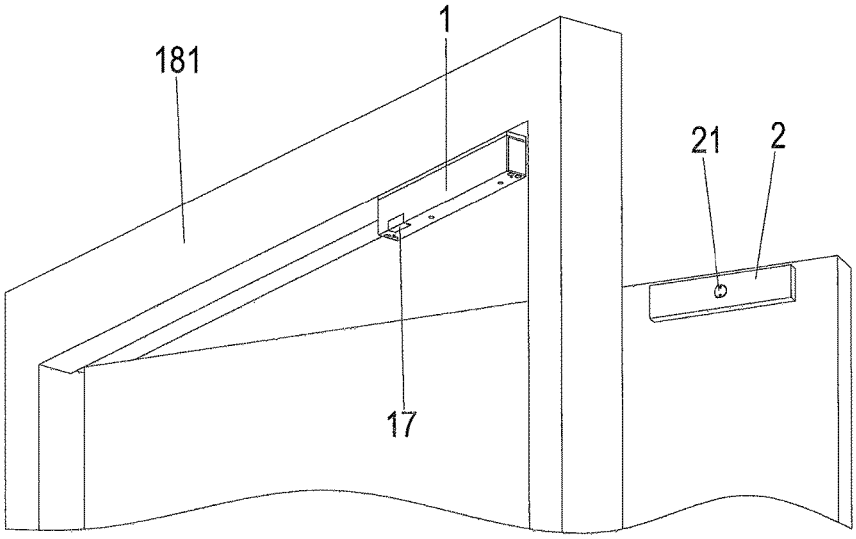
FIG. 2 is a general view of the energy saving magnetic lock shown in FIG. 1 when the door is open.

Preferably, as shown in FIGS. 1 and 2, the sensor 13 is secured to a circuit board 131. The circuit board 131 is secured to a bottom surface of the electromagnet 1 which is secured inside a lock housing 18. A control panel 15 is secured between the electromagnet 1 and terminal plates 183 inside the lock housing 18. The indicator 17 is mounted in the lock housing 18 with a luminous surface facing outward. The two terminal plates 183, a cover 184 and the lock housing 18 are assembled to support and package the first lock module (I). During installation of the first module to a doorframe, at first the first side plate 182 is fixed to the upper edge 181 of the door frame, the side plate 182 is provided with threads 185 at both ends thereof and the threads 185 corresponds to through-holes of two terminal plates 183, then the lock housing 18 is fixed to the side plate 182 by fasteners 186 through the threads at both ends of the through-holes of the terminal plate 183.

The open position of the counterbore 22 in the suction face of the iron plate 2 corresponds to the open position of the slot 12 in the suction face of the electromagnet 1. The axis of the counterbore 22 is perpendicular to the suction surface of the iron plate 2. As shown in FIGS. 3, 4 and 5, the counterbore 22 comprises three adjacent sections which each is a concentric cylindrical channel with a progressive decreased diameter from the suction surface of the iron plate 2. The counterbore 22 comprises a first channel for receiving the cap 211 of the main screw 21, a second channel for receiving the first elastic member 23, and a third channel for receiving a part of the rod of the main screw 21. During assembly of the second lock module (II), the tail of the main screw 21 passes through the center hole of the first elastic member 23 into the third channel, then passes through the third channel and the central hole of the second elastic member 24 disposed between the iron plate 2 and the part of the door, and finally the tail of the main screw 21 is fixed to the door panel. The top surface of the cap 211 is aligned with the suction surface of the iron plate 2. Preferably, the first elastic member 23 can be a butterfly shrapnel or a spring, and the second elastic member 24 can be a rubber ring.

Implementation of energy-saving and warning function in the lock of the present invention is described below.

When the door is open, due to the action of the spring 14, the head of the trip rod 11 projects from the opening of the slot 12 in the suction surface of the electromagnet 1, at the same time the tail of the trip rod 11 is spaced from the sensor 13 at the bottom of the slot 12, as shown in FIGS. 2 and 5. When the door is closed, due to the magnetic force generated as the electromagnet 1 is powered on, the electromagnet 1 and the iron plate 2 are pulled closely together. 0.1 A current passes into the electromagnet. The head of the trip rod 11 projecting from the pull-surface of the electromagnet is pressed to a level of suction surface of the electromagnet 1 thereby the spring 14 is deformed so that the tail of the trip rod 11 touches the sensor 13 and furthermore the circuit control board 15 sends a signal to the indicator 17 so as to indicate that the lock is locked and in the normal state. In this situation, if an external force occurs, due to the suction force between the electromagnet 1 and the iron plate 2, the first elastic member 23 and the second elastic member 24 are deformed (the first elastic member 23 is compressed and the second elastic member 24 expands), the main screw 21 together with the door panel axially moves with respect to the iron plate 2. On the side of the first lock module (I), the trip rod 11 can moves together with the main screw 21 because the spring 14 is deformed to apply a tension to the trip rod 11 when the door is closed. Consequently, the tail of the trip rod 11 is away from the sensor 13 and this separation of the trip rod 11 and the sensor 13 causes the internal electric field of the sensor 13 to change, as shown in FIG. 4. Then, the control board 15 coupled to the sensor 13 issues a command to enhance normal current 0.1 A of the entire circuit to high current 0.5 A of alert to achieve the effect of protecting the access guard. Meanwhile, the circuit control board 15 issues a warning command to the indicator 17 to start alarm.

Alternately or additionally, the lock of the present invention can be provided with an auditory alarm and/or a visual alarm of any other type.

In summary, in the present invention the sensor is triggered by displacement of the trip rod, which is caused by movement of the door panel under an external force. The circuit controller can compare a pressure value of the trip rod on the sensor detected by the sensor with a predetermined value. The magnetic lock is instantly converted from the energy-saving (small current) mode to a high tension (high current) mode and meanwhile an alarm is triggered if the pressure of the trip rod on sensor is less than or equal to the predetermined pressure. The magnetic lock is back to a normal low current state if the pressure of the trip rod on sensor is above the predetermined pressure.

The invention claimed is:

1. An energy-saving magnetic lock, the energy-saving magnetic lock comprising:

a first lock module mounted to a part of a door such as a doorframe; and a second lock module, mounted to the other part of the door such as a door panel which pivots about the doorframe, for interacting with the first lock module, wherein the first lock module comprises:

an electromagnet;

a slot with an opening in a suction surface of the electromagnet extending to the bottom of the electromagnet;

a trip rod inserted inside the slot;

a sensor equipped at the slot end;

a member, which is arranged between the trip rod and the slot, allowing the trip rod to move toward the slot opening axially a predetermined distance when the pressing force on the head of the trip rod is less than the predetermined value;

a circuit control board to which the electromagnet and the sensor are electrically coupled respectively, wherein the trip rod has a length equal to the distance between the slot opening and a surface of the sensor facing the slot opening; and wherein the second lock module comprises:

an iron plate installed on or In the part of the door panel by a main screw, wherein the main screw comprises:

a rod whose end passes through a counterbore of the iron plate and being secured to the part of the door; and a cap abutting against the head of the trip rod when the electromagnet and the iron plate are sucked together and wherein a first elastic member is arranged between the iron plate and the cap of the main screw, and a second elastic member is arranged between the iron plate and the part of the door;

wherein the sensor is triggered by displacement of the trip rod, which is caused by movement of the door panel under an external force;

wherein the circuit control board compares a pressure value of the trip rod on the sensor detected by the sensor with a predetermined value;

wherein the magnetic lock is instantly converted from the energy-saving mode to a high tension mode and meanwhile an alarm is triggered if the pressure of the trip rod on the sensor is less than or equal to the predetermined pressure;

wherein the magnetic lock is back to a normal low current state if the pressure of the trip rod on the sensor is above the predetermined value; and wherein a current in the energy-saving mode is smaller than a current in the high tension mode.

2. The energy-saving magnetic lock as claimed in claim 1, wherein the member, which is arranged between the trip rod and the slot, allowing the trip rod to move toward the slot opening axially a predetermined distance when the pressing force on the head of the trip rod is less than the predetermined value comprises:

a flange projecting radially outwardly from a side wall of the trip rod;

at least two adjacent channels of different diameter constituting the slot; and a spring arranged around the outer periphery of the trip rod between the flange of the trip rod and the slot.

3. The energy-saving magnetic lock as claimed in claim 2, wherein the slot comprises:

three adjacent sections, which comprise:

a first channel, a second channel and a third channel, each is a concentric cylindrical channel with an incremental diameter from the suction face of the electromagnet.

4. The energy-saving magnetic lock as claimed in claim 3, wherein the first channel has a diameter which is greater than the rod diameter of the trip rod but smaller than the flange diameter of the trip rod; the second channel has a diameter which is greater than the flange diameter of the trip rod; and the third channel has a headless screw secured therein and the headless screw is opened a central bore through which the tail of the trip rod passes.

5. The energy-saving magnetic lock as claimed in claim 4, wherein the spring is arranged between the flange of the trip rod and the headless screw secured inside the slot.

6. The energy-saving magnetic lock as claimed in claim 4, wherein the sensor has a U-shaped structure and an inductive surface of the sensor-faces the center of the headless screw.

7. The energy-saving magnetic lock as claimed in claim 4, wherein the tail of the trip rod passes through the headless screw and arrives at the center of the sensor where the trip rod is axially movable.

8. The energy-saving magnetic lock as claimed in claim 1, wherein the sensor is a pressure sensor or an optocoupling sensor.

9. The energy-saving magnetic lock as claimed in claim 1, wherein the open position of the counterbore in the suction surface of the iron plate corresponds to the open position of the slot in the suction surface of the electromagnet, and the counterbore comprises:

three adjacent sections, which each is a concentric cylindrical channel with a progressive decreased diameter from the suction surface of the iron plate.

10. The energy-saving magnetic lock as claimed in claim 9, wherein the counterbore comprises:

a first channel for receiving the cap of the main screw, a second channel for receiving the first elastic member, and a third channel for receiving a part of the rod of the main screw, during assembly of the second lock module, the tail of the main screw passing through a center hole of the first elastic member into the third channel, then passing through the third channel and a central hole of the second elastic member arranged between the iron plat and the part of the door, and finally the tail of the main screw being fixed to the part of the door.

11. The energy-saving magnetic lock as claimed in claim 1, wherein the first elastic member is a butterfly shrapnel or a spring.

12. The energy-saving magnetic lock as claimed in claim 1, wherein the second elastic member is a rubber ring.

13. The energy-saving magnetic lock as claimed in claim 1, wherein the first lock module further comprises:

a lock housing for supporting and packaging it and the lock housing is provided with an indicator which is electrically coupled to the circuit control board.

* * * * *